United States Patent [19]

Yasui

[11] Patent Number: 4,589,360

[45] Date of Patent: May 20, 1986

[54] SEWING CONTROL SYSTEM FOR A SEWING MACHINE

[75] Inventor: Hideo Yasui, Tokyo, Japan

[73] Assignee: Tokyo Juki Industrial Co., Ltd., Chofu, Japan

[21] Appl. No.: 766,904

[22] Filed: Aug. 16, 1985

[30] Foreign Application Priority Data

Aug. 31, 1984 [JP] Japan ..... 59-182292

[51] Int. Cl.[4] ..... D05B 19/00; D05B 69/20

[52] U.S. Cl. ..... 112/121.11; 112/277; 112/300

[58] Field of Search ..... 112/121.11, 121.12, 112/121.29, 275, 277, 262.1, 300, 130

[56] References Cited

U.S. PATENT DOCUMENTS 3,750,603 8/1973 Martin ..... 112/121.11 X 4,195,582 4/1980 Novick et al. ..... 112/121.11

FOREIGN PATENT DOCUMENTS 56-46619 11/1981 Japan ..... 112/121.11 UX

*Primary Examiner*—Peter Nerbun

*Attorney, Agent, or Firm*—Yount & Tarolli

[57] ABSTRACT

A sewing control system for a sewing machine which comprises a count circuit for counting signals synchronized with the rotation of the sewing machine, a memory circuit for storing a reference value, a comparator circuit for comparing said reference value with the output value from said count circuit, an initializing circuit for initializing said count circuit only when there is a comparison output from said comparator circuit after said reference value is stored, and a circuit for outputting a sewing finish signal as data on the number of the works sewn only when there is a comparison output.

5 Claims, 2 Drawing Figures

2
1
23
EDGE GENERATION
20
S F·F
R1
R2
25
21
STEP ON GENERATION
22
INITIAL RESET
7
6
12
COMPARATOR
15
R
COUNTER
SUBTRACTION
17
10
LATCH
S
9
18
THREAD CUTTING GENERATION
NEEDLE POSITION
14
26
OUTPUT
27
+VDD
+VDD
5
A
B
C

I
II
α
β

SEWING CONTROL SYSTEM FOR A SEWING MACHINE

BACKGROUND OF THE INVENTION

The present invention relates to a sewing control system for sewing machine which counts the number of works sewn at each sewing process to control the output of works to be sewn.

In the prior art sewing control system, the operator operates the lever of a mechanical counter provided on the sewing machine table to provide a counter input everytime he sews one work. This complicates the sewing operation. The operator may often err in inputting the count or fail to input the count.

Heretofore, a system has been known in which the operator operates an electrical switch provided on the sewing machine table everytime he sews one work to input the number of works sewn to a counter in a central control unit. Like the above system, however, this system renders the sewing operation complicated. Similarly, the operator may often err in inputting the count or fail to input the count.

Heretofore, a system has also been known which counts the number of works sewn by counting thread cutting signals or wiper signals from the sewing machine.

However, when a thread cutting takes place in the course of sewing, accurate data can not be obtained, since a thread cutting signal for cutting a thread supplied by a pedal operation or wiper signal also is inputted to the counter as a count of the number of work sewn. This system is also disadvantageous in that the operator must operate a correct switch to correct this error.

SUMMARY OF THE INVENTION

It is therefore an object of the present invention to provide an excellent sewing control system which enables automatic and accurate counting of the number of works sewn at each sewing process without the need of input or correction by the operator.

The present sewing control system is provided with a count circuit for counting signals synchronized with the rotation of the sewing machine, a memory circuit for storing a reference value, a comparator circuit for comparing the output from said count circuit with said reference value, an initializing circuit for initializing said count circuit only when said comparator circuit outputs a comparison after said reference value is stored, and a circuit for outputting a sewing finish signal as a data on the number of works sewn only when said comparison output is generated.

Thus, the present sewing control system enables automatic generation of sewing finish signal when the operator finishes sewing so that accurate data on the number of works sewn can be automatically obtained. Unlike the prior art system, the present system does not require that the operator operates a counter lever or electrical switch everytime he finishes sewing to input sewing finish. This prevents the operator from erring in inputting the count or failing to input the count. This system does not render the sewing operation complicated and thus greatly improves the working efficiency. Furthermore, even if the thread breaks in the course of sewing, the sewing finish signal can be prevented from being generated until sewing is finished, thus providing accurate sewing finish data (data on the number of works sewn). Thus, the present sewing control system has a number of excellent effects.

DESCRIPTION OF THE PREFERRED EMBODIMENT

Figures 1, 2:
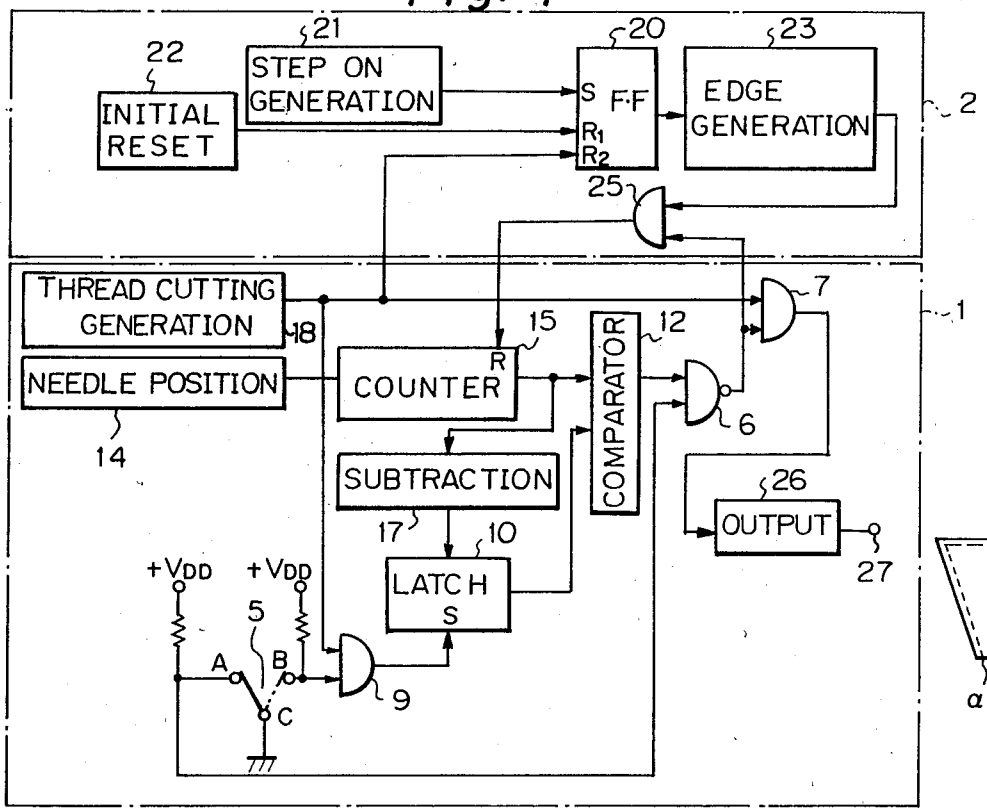
FIG. 1 is a block diagram illustrating the essential part of an embodiment of the present invention.
FIG. 2 is a view illustrating the operation of the embodiment of the present invention.

An embodiment of the present invention will be described hereinafter by referring to the drawings. FIG. 1 mainly comprises a count unit 1 and a counter initializing unit 2. Specifically, shown at 5 in FIG. 1 is a switch which is connected to positive power source $V_{DD}$ through respective resistors at contacts A and B and connected to ground at common contact C. The switching contact A is connected to one input of NAND circuit 6. The output of NAND circuit 6 is connected to one input of AND circuit 7. The switching contact B is connected to AND circuit 9. The output of AND circuit 9 is connected to set terminal S of latch circuit 10. The output of the latch circuit 10 is connected to reference input terminal of comparator circuit 12. The output of needle position generation circuit 14 is connected to counter 15. The output of the counter 15 is connected to comparison input terminal of the comparator circuit 12 and to subtraction circuit 17. The output of the subtraction circuit 17 is connected to the latch circuit 10.

The output of thread cutting generation circuit 18 is connected to the other input of the AND circuit 9 and to the other input of the AND circuit 7. The output of the thread cutting generation circuit 18 is connected to reset terminal $R_2$ of flip-flop 20. Connected to set terminal S of the flip-flop 20 is the output of step-on generation circuit 21 which generates a signal for driving the sewing machine. Connected to the other reset terminal $R_1$ is the output of initial reset circuit 22. The output of the flip-flop 20 is connected to edge generation circuit 23. The output of the edge generation circuit 23 is connected to the other input of AND circuit 25. Connected to the other input of the AND circuit 25 is the output of the NAND circuit 6. The output of the AND circuit 25 is connected to reset terminal R of the counter 15. The output of the AND circuit 7 is connected to output circuit 26. The output of the output circuit 26 is connected to output terminal 27.

FIG. 2 is a view illustrating the operation of an embodiment of the present invention. Shown in FIG. 2 is the process of sewing a collar of a white shirt or the like. Shown at $\alpha$ is the sewing start point and $\beta$ the sewing end point. Let us here suppose that the edge of the collar is to be sewn in about 80 stitches between $\alpha$ and $\beta$.

The operation of the embodiment of the present invention having the above arrangement will be described hereinafter. When power is on, the initial reset circuit 22 generates high level signal (hereinafter referred to as "H signal") which then resets the flip-flop 20 which in turn outputs low level signal (hereinafter referred to as "L signal"). The operator then connects the switch 5 to the contact A to conduct first sewing. When the operator steps on the pedal of the sewing machine, the step-on generation circuit 21 outputs H signal which causes the flip-flop 20 to switch its output to H signal. This causes the edge generation circuit 23 to output an instantaneous H signal. Since L signal is outputted from the switch 5 at this time, H signal is outputted from the NAND circuit 6. This causes the AND circuit 25 to output an instantaneous H signal. The counter 15 is thereby reset so that its content is cleared to zero.

While in sewing, the needle position generation circuit 14 outputs needle position signal representing the position of the needle every stitch (e.g. signal representing needle drop) and the counter 15 counts the needle position signal.

The subtraction circuit 17 always subtracts a constant number from the content of the counter 15 so that the number of stitches is given a tolerance limit taking the dispersion of the quality of the works into account. In the present example, sewing is finished in 80 stitches, and the constant number to be subtracted is set at 5. Therefore, when 75 or more stitches are made, it is considered that one product is finished. When the operator finishes the first work, the counter 15 counts 80 while the subtraction circuit 17 counts 75. When the operator finishes sewing and then steps on the pedal of the sewing machine to cut the thread, the thread cutting generation circuit 18 generates a H level thread cutting signal. As this time the AND circuit 9 is kept open by the source voltage $V_{DD}$. The thread cutting signal is given to set terminal of the latch circuit 10 which in turn latches the value 75 of the subtraction circuit 17 to automatically set the acceptable stitch number of the product. This is the feature of the present invention. The thread cutting signal causes the flip-flop 20 to be reset.

Since the AND circuit 7 is kept open by the output of the NAND circuit 6, the thread cutting signal is given to the output circuit 26 through the AND circuit 7. The output circuit 26 thereby inputs 1 as the number of the works sewn to the counter (not shown) of the central monitor unit connected to the output terminal 27.

To conduct the second and following sewing, the operator connects the switch 5 to the contact B. The AND circuit 9 is closed by L signal from the contact B. This blocks the signal to set terminal of the latch circuit 10 so that the content of the latch circuit 10 is kept at the acceptable stitch number (75). Since the value (80) of the counter 15 is larger than the value (75) of the latch circuit 10 at present, the comparator circuit 12 generates L signal which causes the NAND circuit 6 to output H level signal.

When the operator then steps on the pedal of the sewing machine, the step-on generation circuit 21 outputs H signal which causes the flip-flop 20 to output H level signal which in turn causes the edge generation circuit 23 to generate an instantaneous H signal. At this time, the AND circuit 25 is kept open by H signal from the NAND circuit 6. The value of the counter 15 is reset by H signal from the edge generation circuit 23 to zero. In this state, the comparator circuit 12 is at H level.

When the sewing continues, the counter 15 counts the needle position signal from the needle position generation circuit 14 one by one. When the value of the counter 15 exceeds the acceptable stitch number predetermined by the latch circuit 10 (the range between $\alpha$ and $\beta$ shown by I in FIG. 2), the comparator circuit 12 outputs L signal. The NAND circuit 6 thereby outputs H signal which in turn causes the AND circuit 7 to open. When the sewing is finished and the operator then steps on the pedal of the sewing machine to cut the thread, the thread cutting generation circuit 18 outputs H level thread cutting signal which is then given to the output circuit 26 through the AND circuit 7. The output circuit 26 thereby inputs 1 as the number of the works sewn to the counter (not shown) of the monitor unit. For the following sewings, whenever the sewing is finished, 1 is automatically inputted to the counter of the monitor unit in the same manner as described above so that the total number of the works sewn is automatically counted.

In the event, in the sewing of a second or after piece of a product, that a thread break takes place by some external factor outside the acceptable stitch number range (I in Fig.2) as shown by II in FIG. 2, i.e. in the course of sewing and a thread cutting signal is generated by operating a pedal, an operation of the present invention is conducted. In this case, the thread cutting signal from the thread cutting generation circuit 18 is blocked by the AND circuit 7 so that it is not inputted to the output circuit 26. Specifically, since the count of the counter 15 is smaller than the value predetermined by the latch circuit 10, the comparator circuit 12 outputs H signal which causes the NAND circuit 6 to outputs L level signal which in turn causes the AND circuit to be closed. This blocks all thread cutting signals generated in the course of sewing.

Since the switch 5 is connected to the contact B as described above, the value of the latch circuit 10 is kept unchanged.

When the operator continues sewing from this thread break point (II in FIG. 2) or from several points before this break point, the counter 15 continues to count from the count made immediately before the thread break the needle position signals from the needle position generation circuit 14. Therefore, if the operator normally finishes sewing after the thread break in the course of sewing and then cuts the thread, the count of the counter 15 exceeds the value predetermined by the latch circuit 10. The comparator circuit 12 thereby outputs L signal. Therefore, a thread cutting signal is given to the output circuit 26 which in turn outputs 1 as the number of the works sewn.

While the above embodiment of the counter 15 has been referred to an addition system, the counter 15 may be a subtraction system. In the subtraction system, the subtraction circuit 17 is replaced by an addition circuit for adding a constant value. The comparator circuit 12 compares the stored value in the latch circuit 10 which has been provided by latching the output value from the addition circuit in the same manner as used in the above embodiment with the output value from the subtraction system counter 15. When the output value from the counter 15 is less than the stored value, the comparator circuit 12 generates L level comparison output signal. The output of the AND circuit 25 is connected to preset terminal of the counter 15. The output of the AND circuit 25 which is generated in the same manner as in the above embodiment operates to initialize the counter 15 to preset value.

While the above embodiment has been referred to thread cutting signal generated by the thread cutting generation circuit 18, the operation and effect of the present invention may be similarly attained by a sewing finish generation circuit for generating a sewing finish signal representing the sewing finish such as wiper signal and work holder lift signal.

While the above embodiment has referred to the needle position generation circuit 14 for generating the needle position such as needle drop, the operation and effect of the present invention may be similarly attained by a circuit for generating the signal synchronized with the rotation of the sewing machine main shaft such as sewing machine rotation signal and sewing machine speed signal.

While the above embodiment has been referred to the counter of the monitor connected to the output terminal 27, the counter may be connected to each output terminal 27. The display of the counter may be shared by the display of a digital clock so that both the time data and the counter output are given to the central monitor unit.

Furthermore, the comparator circuit may be of an analog system in which an operational amplifier is used.

Although the invention has been described in its preferred form with a certain degree of particularity, it is understood that the present disclosure of the preferred form has been changed in the details of construction and the combination and arrangement of parts may be restored to without departing from the spirit of the scope of the invention as hereinafter claimed.

What is claimed is:

1. A sewing control system for a sewing machine comprising:

a first circuit for generating a signal synchronized with the rotation of the sewing machine main shaft;

a second circuit for generating a sewing finish signal;

a count circuit for counting the output from said first circuit;

an arithmetic logical circuit for calculating in accordance with the output from said count circuit;

a memory circuit for latching the output value from said arithmetic logical circuit as a reference value in accordance with the output from said second circuit;

a third circuit for prohibiting latching to said memory circuit after said reference value is latched;

a comparator circuit for comparing said reference value with the output value from said count circuit;

a fourth circuit for initializing said count circuit only when there is a comparison output from said comparator circuit while said third circuit is in effect; and a fifth circuit for outputting a sewing finish signal from said second circuit to the output terminal only when there is a comparison output from said comparator circuit.

2. A sewing control system as claimed in claim 1, wherein said count circuit is an addition counter, wherein said arithmetic logical circuit is a subtraction circuit for subtracting a constant value from the output value of said addition counter, wherein said comparator circuit is a circuit for outputting a comparison output when the output value from said addition counter exceeds said reference value, and wherein said fourth circuit is a circuit for resetting said addition counter.

3. A sewing control system as claimed in claim 1, wherein said count circuit is a subtraction counter, wherein said arithmetic logical circuit is an addition circuit for adding a constant value to the output value of said subtraction counter, wherein said comparator circuit is a circuit for outputting a comparison output when the output value from said subtraction counter is less than said reference value, and wherein said fourth circuit is a circuit for presetting said subtraction counter.

4. A sewing control system as claimed in any one of claims 1, 2 and 3, wherein a counter provided in a central monitor unit is connected to said output terminal.

5. A sewing control system as claimed in any one of claims 1, 2 and 3, wherein a counter which shares the display with a clock is connected to said output terminal.

* * * * *